United States Patent [19]

Townsend, Jr. et al.

[11] 4,019,901

[45] Apr. 26, 1977

[54] ULTRA-HIGH STRENGTH STEEL HAVING IMPROVED RESISTANCE TO ENVIRONMENTAL STRESS CORROSION CRACKING

[75] Inventors: Herbert E. Townsend, Jr., Allentown; James B. Horton, Bethlehem; Louis R. Woodyatt, Whitehall, all of Pa.

[73] Assignee: Bethlehem Steel Corporation, Bethlehem, Pa.

[22] Filed: May 10, 1976

[21] Appl. No.: 685,019

Related U.S. Application Data

[62] Division of Ser. No. 371,195, June 18, 1973, Pat. No. 3,966,421.

[52] U.S. Cl. ..... 75/206; 75/211; 148/126

[51] Int. Cl.[2] ..... B22F 3/16; C22C 1/05

[58] Field of Search ..... 75/206, 211; 148/126

[56] References Cited

UNITED STATES PATENTS

| | | | |
|---|---|---|---|
| 3,666,851 | 5/1972 | Chaklader | 75/211 |
| 3,676,079 | 7/1972 | Morgan | 75/206 X |
| 3,698,891 | 10/1972 | Patil et al. | 75/211 X |
| 3,954,458 | 5/1976 | Roberts | 75/211 |
| 3,975,193 | 8/1976 | Nayar | 75/211 |

*Primary Examiner*—Richard E. Schafer
*Attorney, Agent, or Firm*—Joseph J. O'Keefe; John J. Selko

[57] ABSTRACT

An ultra-high strength steel composition of matter having a substantially martensitic matrix with a dispersion therein of a critical amount of metal oxide particles and characterized by increased resistance to environmental stress corrosion cracking. The metal oxide particles are selected from the group consisting of CaO, BaO, MgO, SrO and mixtures thereof, in the range of 0.1 to less than 3 mole percent. A powder metallurgy process to produce articles of manufacture from the composition of matter is disclosed.

2 Claims, 1 Drawing Figure

ULTRA-HIGH STRENGTH STEEL HAVING IMPROVED RESISTANCE TO ENVIRONMENTAL STRESS CORROSION CRACKING

This is a division of application Ser. No. 371,195, filed June 18, 1973 now U.S. Pat. No. 3,966,421.

BACKGROUND OF THE INVENTION

1. Field of the Invention

This invention is related to a composition of matter having increased resistance to environmental stress corrosion cracking, and more particularly to a composition of matter having a heat-treated ferrous metal matrix with a critical amount of a metal oxide dispersed therein to provide increased resistance to environmental stress corrosion cracking.

This invention is further related to a powder metallurgy article of manufacture having a heat-treated ferrous metal matrix and a critical amount of metal oxide dispersed therein to provide increased resistance to environmental stress corrosion cracking, and a process of producing said article of manufacture.

2. Prior Art

It is well known that ultra-high strength steel is defined as steel with a yield strength in excess of 140,000 pounds per square inch. When heat-treated to a yield strength in excess of 160,000 pounds per square inch, such steel becomes susceptible to environmental stress corrosion cracking.

Environmental stress corrosion cracking is a brittle failure which can result from a combination of stress and exposure to a corrosive environment. In the case of heat-treated ultra-high strength steel, environmental stress corrosion cracking can occur in naturally occurring environments such as sea water or the atmosphere.

Environmental stress corrosion cracking is believed to be a form of hydrogen embrittlement cracking that takes place because the conditions which develop within pits, crevices, and cracks lead to an evolution of hydrogen and its absorption by the steel. A key factor leading to the entry of hydrogen is the condition of low pH or acidity which has been observed to develop within stress corrosion cracks.

It is also well known in the art that non-metallic inclusions in the steel can act as initiation sites for environmental stress corrosion cracking and therefore, such inclusions are detrimental to the steel's properties.

Because of the possibility of environmental stress corrosion cracking, the usefulness of ultra-high strength steels is limited. Therefore, there is a need for a heat-treated ultra-high strength steel which exhibits improved resistance to environmental stress corrosion cracking.

SUMMARY OF THE INVENTION

We have discovered a composition of matter having dispersed in a heat-treated ferrous metal matrix a critical amount of metal oxide particles, which composition exhibits improved resistance to environmental stress corrosion cracking. When a metal oxide selected from the group consisting of CaO, BaO, MgO, SrO and mixtures thereof is present in the range of 0.1 to less than 3 mole percent, resistance to environmental stress corrosion cracking is significantly improved.

DETAILED DESCRIPTION OF THE PREFERRED EMBODIMENT

Figure 1:
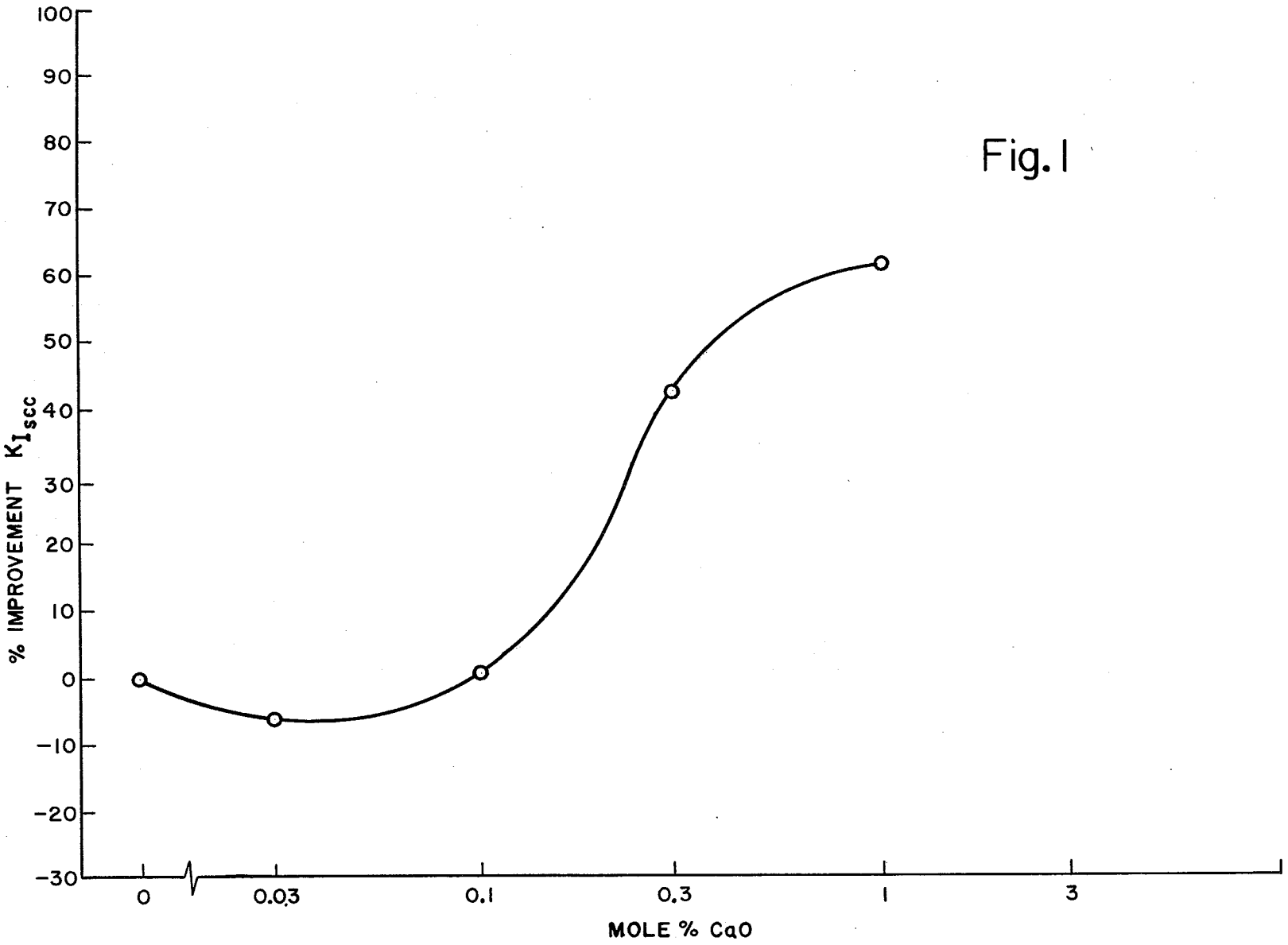
FIG. 1 is a graph showing percent improvement in $K_{Iscc}$ versus mole percent CaO.

The preferred microstructure of the steel of this invention is a ferrous metal matrix which has been heat-treated by heating to a temperature at which austenite is stable, for a sufficient time to allow transformation to austenite, and cooled fast enough to insure transformation of the austenite to substantially all martensite or bainite, and thereby achieving a yield strength in excess of 160,000 pounds per square inch. Particles of a metal oxide, preferably CaO, are uniformly dispersed throughout the ferrous metal matrix. The size of particles is from 5 to 64 microns. The mean interparticle distance depends upon the concentration of metal oxide present. In the critical range of 0.1 to less than 3 mole percent CaO, equivalent to a weight percent of 0.1 to less than 3, the mean interparticle distance is calculated as being respectively from about 0.0065 to 0.0012 inches.

FIG. 1 shows a graph of the percent improvement in the resistance of the composition of this invention to environmental stress corrosion cracking versus mole percent CaO content. As is known in the art, the threshold stress intensity at which environmental stress corrosion cracks propagate is known as $K_{Iscc}$, and an increase in a metal's $K_{Iscc}$ value represents improved resistance to environmental stress corrosion cracking.

At 0.0% CaO, the prior art ferrous matrix is represented. With CaO amounts up to about 0.1 mole percent the susceptibility toward cracking remains essentially the same as the prior art ferrous matrix. However, at an amount of CaO equal to about 0.1 mole percent, an unexpected change in behavior occurs and the resistance to stress corrosion cracking begins to improve. This improvement continues with increasing amounts of CaO dispersed, and at 1 mole percent CaO, there is noted a total improvement of about 62 percent in the resistance of the steel to environmental stress corrosion cracking, a significant improvement.

It is believed that the particles of CaO which are randomly and uniformly dispersed throughout the ferrous matrix chemically react with any acidic material such as HCl or $FeCl_3$ which develops within the stress corrosion cracks and thereby raises the pH of the acidic material, which has the effect of minimizing absorption of hydrogen into the ferrous matrix. By minimizing hydrogen absorption, the CaO particles minimize embrittlement and improve resistance to environmental stress corrosion cracking.

In performing the present invention, the following powder metallurgy techniques are preferably employed.

Reagent grade CaO powder is heated in an excess of air to drive off $H_2O$ and $CO_2$ impurities from the CaO. Such heating is hereinafter referred to as calcining. The calcining step is necessary to prevent internal oxidation of the powder metal compact during sintering. The calcined powder particle size is in the range of 5 to 65 microns.

The ferrous matrix is to be produced from a pre-alloyed iron alloy powder having any well known composition which will produce a yield strength in excess of 160,000 pounds per square inch after treatment by conventional powder metallurgy and heat-treatment techniques.

A mixture is formed by mixing a critical amount of calcined CaO powder, pre-alloyed iron powder, natural graphite and zinc stearate in a Vee-type blender for one-half hour. The zinc stearate was added as a lubricant for the compacting operation, as is well known. The graphite was added to supply carbon to the mixture to make high strength levels subsequently possible, since the pre-alloyed iron powder was deficient in carbon. Had the pre-alloyed iron powder contained sufficient carbon, the graphite could have been eliminated.

The mixture is compacted into an appropriate compact to an as-pressed density of 6.5 gm/cm$^3$ according to conventional techniques.

The compact is next heated to drive off zinc stearate and sintered in an endothermic gas as is well known.

The compact is preheated and hot forged to final shape according to methods well known in the art.

Finally, the compact is heat-treated according to conventional techniques to provide a composition of matter having a dispersion of a critical amount of CaO particles in a substantially martensitic matrix, in which the composition is characterized by an improved resistance to environmental stress corrosion cracking, at a yield strength in excess of 160,000 pounds per square inch.

EXAMPLE I

The invention will be further described by means of the following specific example. Reagent grade CaO powder was calcined for one hour at 1475° F. The calcined CaO powder size was 5 to 65 microns with 50 percent by weight of the particles being smaller than 9 microns. Table I lists the standard of purity of the reagent grade CaO powder.

TABLE I

| | |
|---|---|
| Insoluble in $CH_3COOH$ and $NH_4OH$ Precipitate | 1.0% max. |
| Loss on Ignition | 5.0% max. |
| Chloride (Cl) | 0.005% max. |
| Nitrate ($NO_3$) | 0.050% max. |
| Sulfate ($SO_4$) | 0.10% max. |
| Heavy Metals (as Pb) | 0.005% max. |
| Iron (Fe) | 0.050% max. |

The ferrous matrix was produced from a pre-alloyed iron powder with the following typical weight percent composition: Carbon less than 0.01; Manganese – 0.20; Phosphorus — 0.008; Sulfur — 0.015; Silicon — 0.02; Oxygen — 0.091; Nickel — 1.90; and Molybdenum – 0.50.

A series of mixtures was produced by mixing in a Vee-type blender for one-half hour the pre-alloyed iron alloy powder, 0.6 percent by weight of natural graphite, 0.75 percent by weight zinc stearate, and CaO powder in the following weight percentages: 0.0; 0.03; 0.1; 0.3; 1; and 3. For CaO, the weight percent is approximately equal to the mole percent. For instance, 0.1 weight percent CaO is equal to 0.0991 mole percent, 1 weight percent CaO is equal to 0.991 mole percent, and 3 weight percent CaO is equal to 2.97 mole percent CaO.

Each mixture was pressed into a 4 × 1½ × 1 inch compact under a pressure of 80,000 psi. with an as pressed density of 6.5 gm/cm$^3$.

Immediately prior to sintering, the specimens were heated in air for one half hour at 1200° F. Sintering took place in endothermic gas at 2050° F. for twenty minutes.

Hot forging was performed in a partially closed die with a single stroke from a 1000 ten press, after the specimens were preheated to 1700° in argon.

Chemical analyses of the as-forged articles are given in Table II. All figures are in weight percent.

TABLE II

| % CaO added | 0 | 0.03 | 0.1 | 0.3 | 4 | 3 |
|---|---|---|---|---|---|---|
| C | 0.58 | 0.57 | 0.56 | 0.61 | 0.60 | 0.60 |
| Mn | 0.14 | 0.14 | 0.14 | 0.14 | 0.14 | 0.14 |
| P | 0.004 | 0.004 | 0.004 | 0.004 | 0.004 | 0.004 |
| S | 0.013 | 0.012 | 0.014 | 0.013 | 0.014 | 0.015 |
| Si | 0.02 | 0.02 | 0.02 | 0.02 | 0.02 | 0.02 |
| Ni | 1.85 | 1.86 | 1.87 | 1.85 | 1.86 | 1.78 |
| Mo | 0.51 | 0.51 | 0.50 | 0.50 | 0.50 | 0.52 |
| Ca | 0.004 | 0.024 | 0.073 | 0.21 | 0.64 | 1.97 |

After the hot forging, cantilever beam specimens were machined for air toughness and stress corrosion tests as is well known in the art and described by B. F. Brown, in *Materials Research and Standards*, MTRSA, Vol. 6, No. 3, 1966, pp. 129–133.

The cantilever beam specimens were austenitized at 1525° F. and quenched, as noted in Table III, and tempered one hour at 500° F.

TABLE III

| Wt. Percent CaO Added | Quench Medium |
|---|---|
| 0.0 | oil |
| 0.03 | oil |
| 0.1 | water |
| 0.3 | water |
| 1 | water spray |
| 3 | water spray |

It was necessary to progressively increase the severity of the quench media with increasing CaO content in order to obtain the approximately equal as-quenched strength levels. This change in quench media is probably necessary because the reduced thermal conductivity of the oxide-laden steel tends to reduce the actual cooling rate in a given quench media.

The cantilever beam specimens were fatigue precracked according to well known means by fatigue cycling using a load between 250 to 2500 lbs. in a three-point bending across a 3.6 inch span at 26.5 Hz until a crack 0.2 to 0.3 inches in length, notch depth included, was produced.

Tests were conducted to determine $K_{Ix}$, the critical stress intensity for fracture in air, and $K_{Iscc}$, the critical stress intensity at which an environmental stress corrosion crack propagates. The methods whereby these tests are conducted are well known in the art, and are described in the above mentioned publication , and by H. E. Townsend, jr. in "Resistance of High Strength Structural Steel to Environmental Stress Corrosion Cracking," Stress Corrosion Cracking of Metals — A State of the Art, ASTM STP 15, American Society for Testing and Materials, 1972, pp. 155–166. The results of these tests appear in Table IV.

TABLE IV

| Wt. Percent CaO | $K_{Ix}$ (ksi in.) | $K_{Iscc}$ (ksi in.) |
|---|---|---|
| 0.0 | 27.3 | 13.3 |
| 0.03 | 30.7 | 12.5 |
| 0.1 | 24.5 | 13.2 |
| 0.3 | 26.2 | 19.0 |
| 1 | 24.3 | 21.5 |
| 3 | 25.2 | 24.5 |

Following the air toughness tests, 2 inch long by 0.126 inch diameter tensile specimens were machined from the broken air toughness specimens. Tensile test data are in Table V.

TABLE V

| Wt. Percent CaO | 0.2% Yield Strength psi. | Ultimate Tensile Strength psi. | % Reduction in Area |
|---|---|---|---|
| 0.0 | 204,000 | 252,000 | 9.5 |
| 0.03 | 189,000 | 246,000 | 6.6 |
| 0.1 | 216,000 | 237,000 | 3.4 |
| 0.3 | 181,000 | 196,000 | 2.1 |
| 1 | 186,000 | 197,000 | 1.4 |
| 3 | 150,000 | 155,000 | 1.1 |

The specimen with 3 weight percent CaO, equivalent to 3 mole percent CaO, did not achieve the necessary minimum yield strength of 160,000 pounds per square inch to assure the presence of a tendency to exhibit stress corrosion cracking. It is believed that a CaO concentration between 1 and 3 weight percent, corresponding to a mole percent of 1 and 3 respectively, a specimen with a minimum yield strength of 160,000 pounds per square inch can be achieved, and the corresponding $K_{Iscc}$ would be expected to be between 21.5 and 24.5. Thus, the critical range for concentration of CaO appears to be bounded on the upper limit at some concentration less than 3 mole percent but more than 1 mole percent CaO.

Table VI shows the percent improvement in resistance to environmental stress corrosion cracking as a function of mole percent and weight percent CaO.

TABLE VI

| Mole Percent CaO | Wt. Percent CaO | $K_{Iscc}$ | Percent Improvement in $K_{Iscc}$ |
|---|---|---|---|
| 0 | 0.0 | 13.3 | — |
| 0.03 | 0.03 | 12.5 | −6.0 |
| 0.1 | 0.1 | 13.2 | +0.8 |
| 0.3 | 0.3 | 19.0 | +42.9 |
| 1 | 1 | 21.5 | +61.7 |
| 3 | 3 | 24.5 | +84.2 |

The percent improvement in $K_{Iscc}$ at 3 mole percent CaO is discarded because of insufficient yield strength of the specimen. At the critical upper limit for CaO, thought to be between 1 and 3 mole percent CaO, the percent improvement in $K_{Iscc}$ is believed to be between 61.7 and 84.2.

Metallographic specimens were prepared from the tensile test specimens by conventional techniques. The mean interparticle distance was found to be in fairly good agreement with the calculated interparticle distance listed in Table VII.

TABLE VII

| Weight Percent CaO | Mean Interparticle Distance - Inches |
|---|---|
| 0.0 | — |
| 0.03 | 0.0117 |
| 0.1 | 0.0065 |
| 0.3 | 0.0037 |
| 1 | 0.0021 |
| 3 | 0.0012 |

While the heat-treated ferrous matrix of this invention was disclosed to be substantially martensite, one skilled in the art would recognize that other types of heat-treated ferrous matrixes would be similarly improved. For instance, this invention would work with any heat-treated high strength ferrous microstructure such as bainite, or mixtures of martensite and bainite or martensite and pearlite, or even stainless steels, provided the heat-treated steel matrix has sufficient yield strength to cause it to be susceptible to environmental stress corrosion cracking.

Also, the composition of this invention can be produced by other methods, such as dispersing the metal oxide in molten metal, so long as the critical amount of metal oxide is dispersed as described.

Finally, while the dispersions of this invention were disclosed to be of CaO, it should be recognized that other metal oxides are the chemical equivalent of CaO, most notably, BaO, MgO, and SrO, which are all oxides of metals in the same group and sub-group of the periodic table. Because of the chemical similarity of these oxides, their chemical behavior at the same mole percent concentrations would be known to one skilled in the art to be functionally the same as CaO in the presence of acidic material such as HCl or $FeCl_3$. Therefore, oxides such as BaO, MgO, and SrO are interchangeable with CaO and form part of this invention.

We claim:

1. In a process for producing a powder metallurgy article of manufacture having a dispersion of a metal oxide in a ferrous metal matrix including in order the steps of mixing a metal oxide powder, a ferrous metal powder, zinc stearate, and natural graphite to form a mixture, forming a compact from said mixture, heating said compact, sintering said compact, hot working said compact, and heat treating said compact, the improvement comprising:

a. calcining said metal oxide powder before said metal oxide powder is mixed with said ferrous metal powder, zinc stearate, and natural graphite.

2. The invention of claim 1 in which said calcining takes place for one hour at about 1475° F.

* * * * *